US010011085B2

(12) United States Patent
Tan

(10) Patent No.: US 10,011,085 B2
(45) Date of Patent: Jul. 3, 2018

(54) METHOD FOR MAKING TRI-FOLD SIDE SEAMED PLASTIC PRODUCE BAG

(71) Applicant: Greg Tan, Harahan, LA (US)

(72) Inventor: Greg Tan, Harahan, LA (US)

( * ) Notice: Subject to any disclaimer, the term of this patent is extended or adjusted under 35 U.S.C. 154(b) by 0 days.

(21) Appl. No.: 15/499,908

(22) Filed: Apr. 28, 2017

(65) Prior Publication Data

US 2017/0297775 A1 Oct. 19, 2017

Related U.S. Application Data

(60) Division of application No. 14/263,794, filed on Apr. 28, 2014, now Pat. No. 9,725,211, which is a division of application No. 13/566,491, filed on Aug. 3, 2012, now Pat. No. 8,708,879, which is a continuation of application No. 13/101,946, filed on May 5, 2011,
(Continued)

(51) Int. Cl.

| | |
|---|---|
| ***B65D 33/00*** | (2006.01) |
| ***B31B 27/00*** | (2006.01) |
| ***B31B 19/18*** | (2006.01) |
| ***B31B 19/14*** | (2006.01) |
| ***B31B 19/26*** | (2006.01) |
| ***B31B 19/64*** | (2006.01) |

(52) U.S. Cl.

CPC ..... *B31B 27/00* (2013.01); *B31B 19/14* (2013.01); *B31B 19/18* (2013.01); *B31B 19/26* (2013.01); *B31B 19/64* (2013.01); *B65D 33/002* (2013.01); *B65D 33/007* (2013.01); *B31B 2219/14* (2013.01); *B31B 2219/146* (2013.01); *B31B 2219/26* (2013.01); *B31B 2219/6053* (2013.01); *B31B 2219/88* (2013.01); *B31B 2237/10* (2013.01); *B31B 2237/403* (2013.01); *B31B 2237/60* (2013.01)

(58) Field of Classification Search

CPC ..... B31B 27/00; B31B 19/00; B31B 19/10; B31B 19/14; B31B 19/18; B31B 19/20; B31B 19/26; B31B 19/60; B31B 19/64; B65D 33/00; B65D 33/002; B65D 33/007

See application file for complete search history.

(56) References Cited

U.S. PATENT DOCUMENTS

| | | | | |
|---|---|---|---|---|
| 5,435 A | | 2/1848 | Punch | |
| 2,444,685 A | * | 7/1948 | Waters | B31B 70/00 156/260 |

(Continued)

*Primary Examiner* — Jacob T Minskey
*Assistant Examiner* — Matthew Hoover
(74) *Attorney, Agent, or Firm* — David A. Belasco; Belasco Jacobs & Townsley, LLP

(57) ABSTRACT

A trifold side seamed film produce bag includes a front wall and a back wall, first and second side edges sealed together and a seamless bag bottom. The bag is joined at the side edges to additional bags by a perforation. The bag is corona treated on at least one wall and promotional material is printed on the treated surface. The bags are folded to one third of their height to fit compact bag roll dispensers. The bags are folded in a Z-fold or C-fold configuration. The method includes manufacturing the bags and winding them onto cores or forming the bags into coreless rolls. An apparatus for forming the side seamed bags includes an extruder, a tubing flattener, a perforator, a sealer, a corona treater, a printer and a slitter. The treated, printed bags may be stored on rolls for later slitting into two bag streams and folding into thirds.

12 Claims, 15 Drawing Sheets

Related U.S. Application Data now Pat. No. 8,317,670, which is a division of application No. 11/829,017, filed on Jul. 26, 2007, now Pat. No. 7,963,898.

(56) References Cited

U.S. PATENT DOCUMENTS

| | | | | |
|---|---|---|---|---|
| 3,115,295 | A | 12/1963 | Nash | |
| 3,308,722 | A | 3/1967 | Peterson | |
| 3,372,625 | A | 3/1968 | Simecek et al. | |
| 3,448,915 | A | 6/1969 | Schwarzkopf | |
| 3,469,769 | A | 9/1969 | Guenther | |
| 3,605,571 | A | 9/1971 | Titchenal | |
| 3,749,237 | A | 7/1973 | Dorton | |
| 3,931,886 | A | 1/1976 | Tamauchi | |
| 4,106,395 | A | 8/1978 | Rochia | |
| 4,164,170 | A | 8/1979 | Nordin | |
| 4,363,437 | A | 12/1982 | Scherz | |
| 4,759,742 | A | 7/1988 | Achelpohl | |
| 4,811,418 | A | 3/1989 | Relfenhauser | |
| 4,892,512 | A | 1/1990 | Branson | |
| 5,096,305 | A | 3/1992 | Rimondl et al. | |
| 5,573,489 | A | 11/1996 | Letendre et al. | |
| 5,611,627 | A | 3/1997 | Bellas et al. | |
| 5,890,810 | A | 4/1999 | Barlow | |
| 5,941,393 | A | 8/1999 | Wilfong, Jr. | |
| 5,967,663 | A | 10/1999 | Vaquero et al. | |
| 6,159,136 | A | 12/2000 | Belias et al. | |
| 6,183,132 | B1 | 2/2001 | Simhaee | |
| 6,196,717 | B1 | 3/2001 | Belias et al. | |
| 6,286,680 | B1 | 9/2001 | Hofrichter | |
| 6,379,292 | B1 | 12/2002 | West et al. | |
| 6,488,222 | B1 | 12/2002 | West et al. | |
| 7,104,942 | B2 | 12/2006 | Tan | |
| 7,611,770 | B2 * | 11/2009 | Kennedy | B32B 27/08 428/355 EN |

* cited by examiner

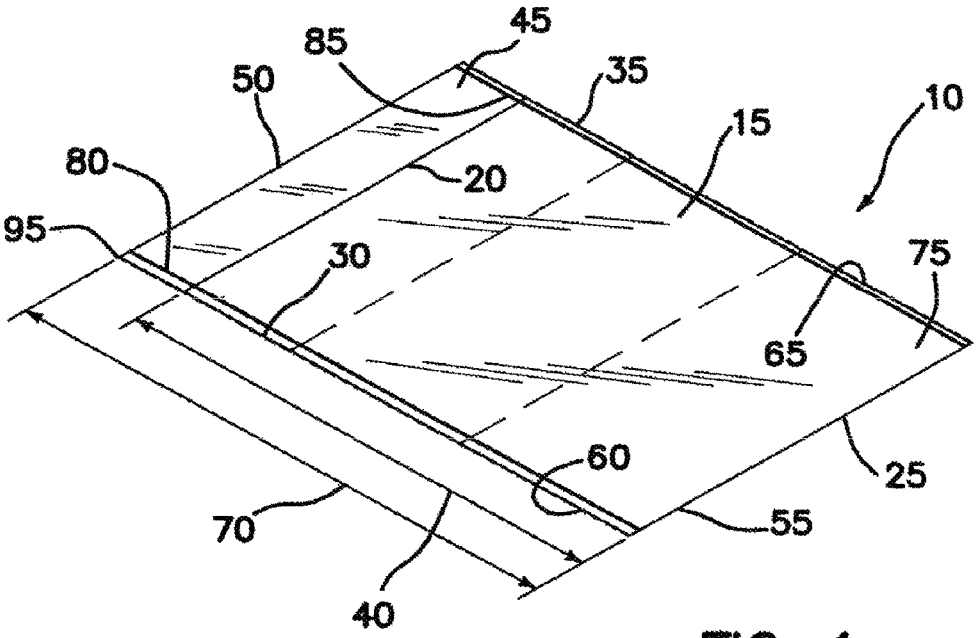
FIG. 1
FIG. 1A
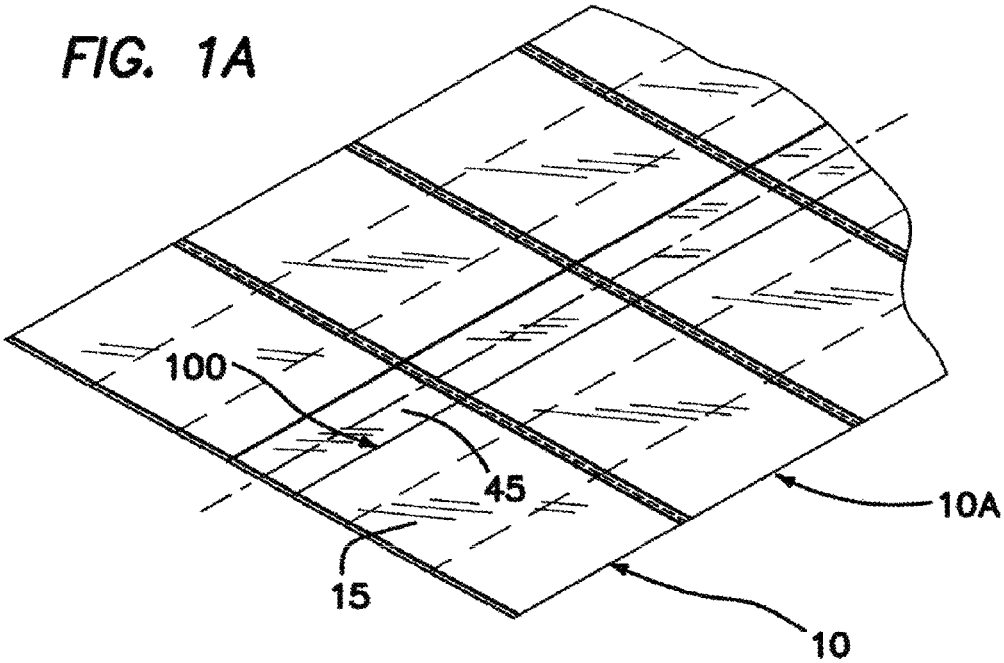

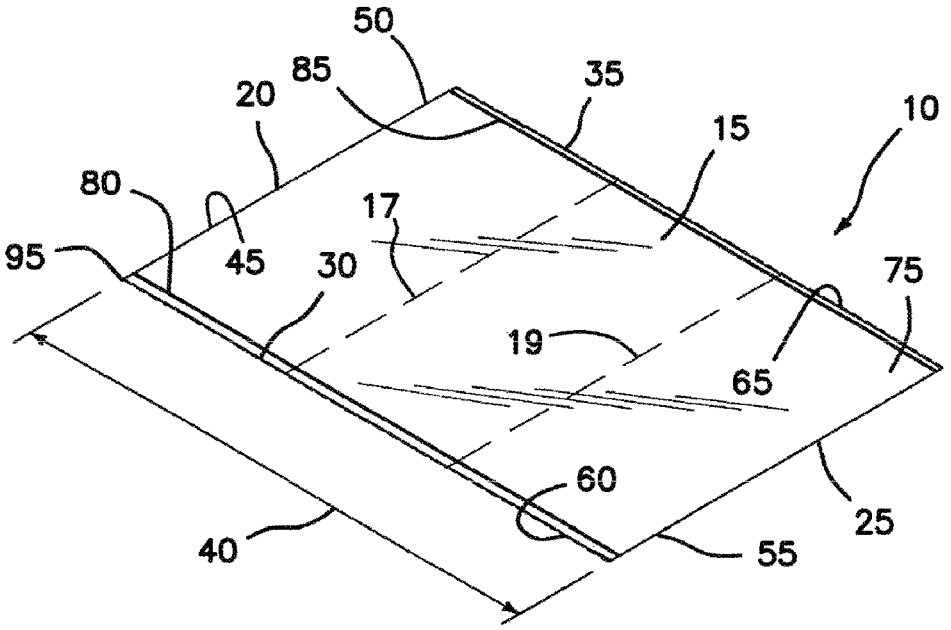
FIG. 17
FIG. 17A
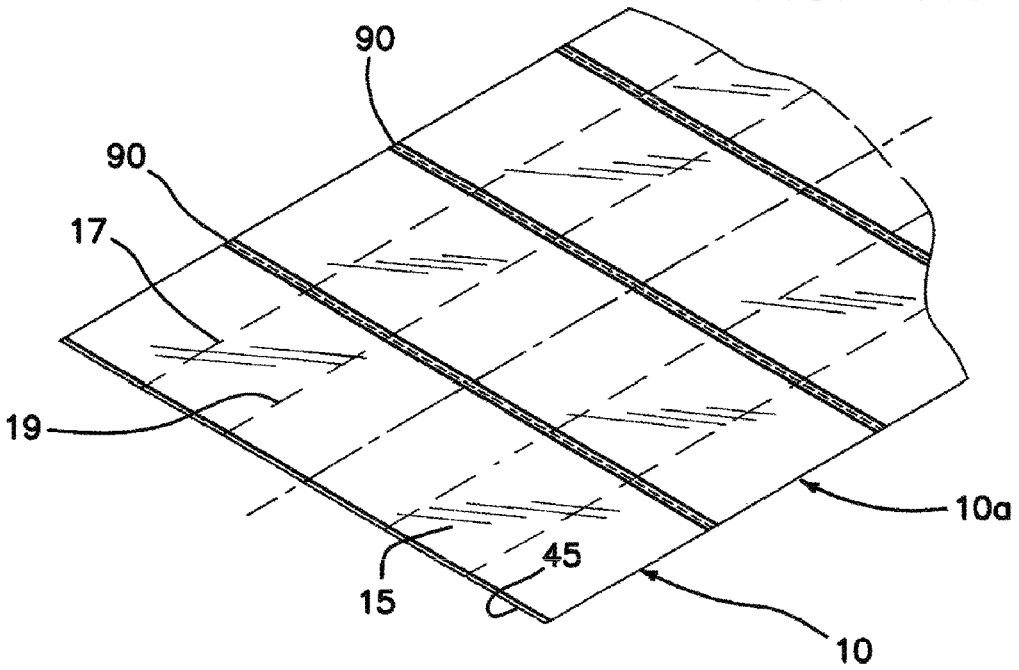

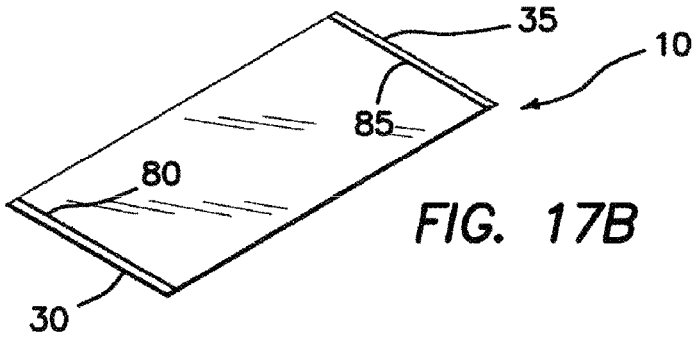
FIG. 17B
FIG. 22
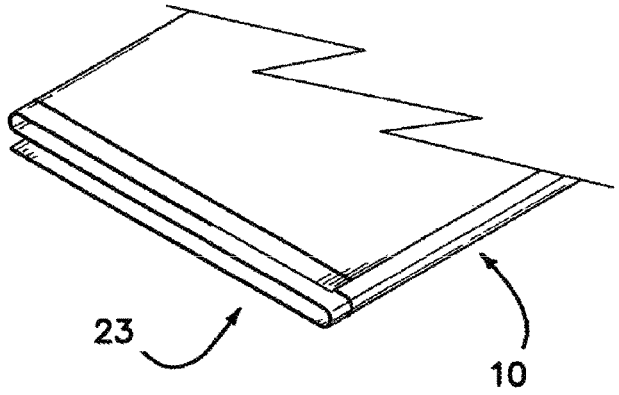
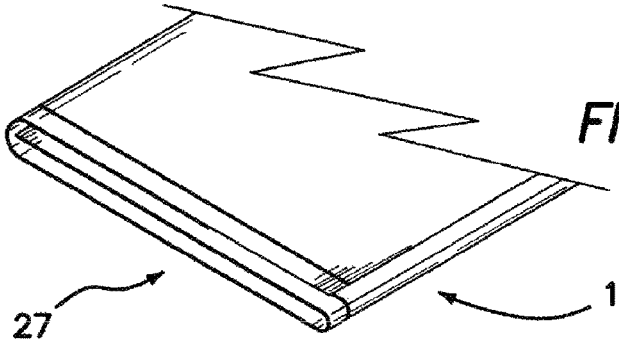
FIG. 23

FIG. 20
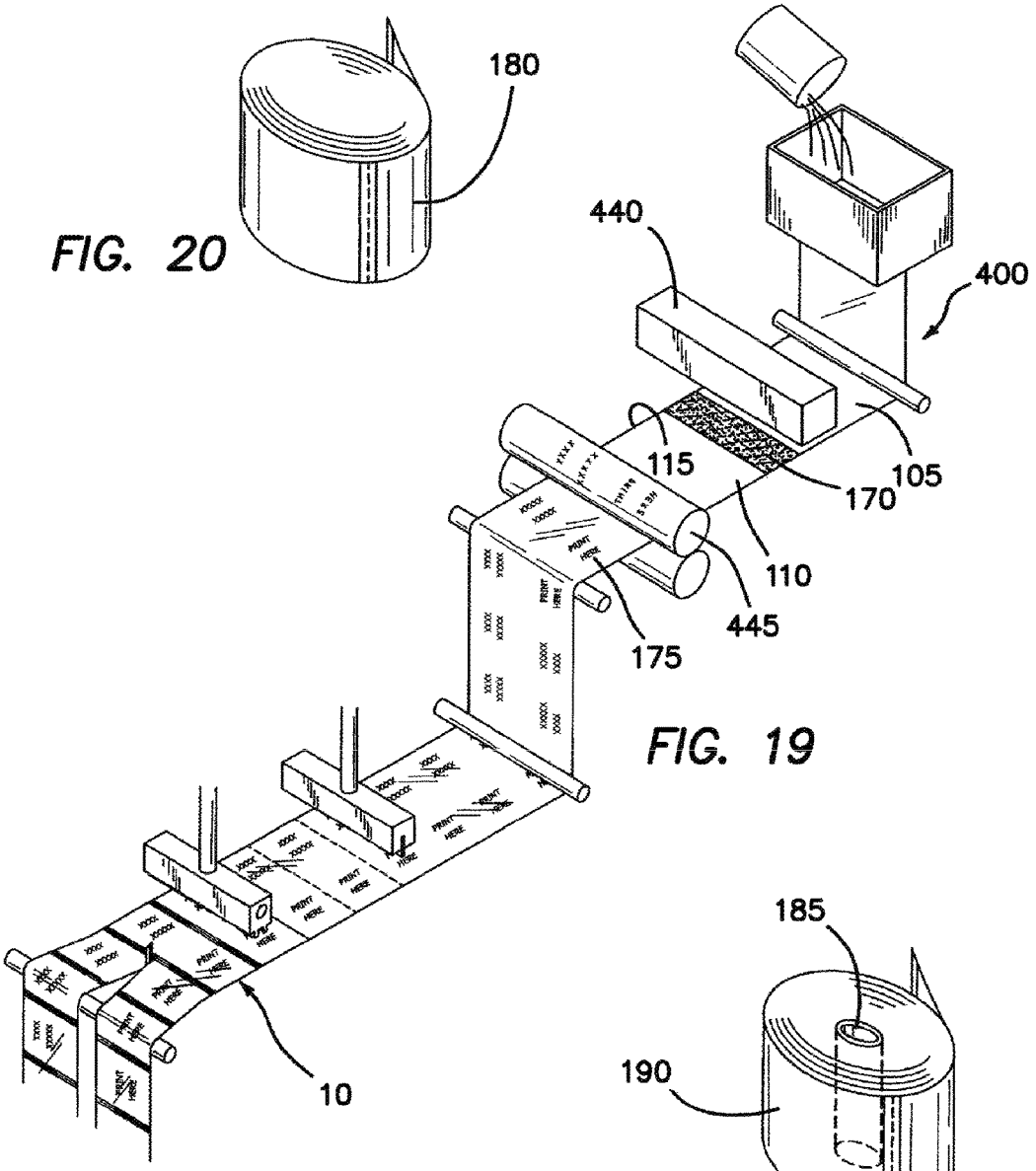
FIG. 19
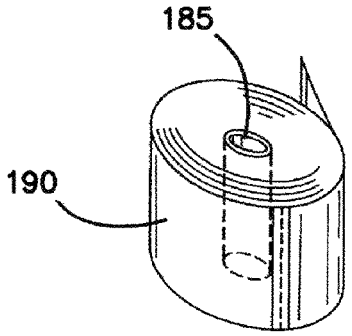
FIG. 21

METHOD FOR MAKING TRI-FOLD SIDE SEAMED PLASTIC PRODUCE BAG

RELATED APPLICATIONS

The instant application is a divisional of U.S. application Ser. No. 14/263,794, filed Apr. 28, 2014 and currently pending, which is a divisional of U.S. application Ser. No. 13/566,491, filed Aug. 3, 2012, issued as U.S. Pat. No. 8,708,879, which is a continuation of U.S. application Ser. No. 13/101,946, filed May 5, 2011, issued as U.S. Pat. No. 8,317,670, which is a divisional of U.S. application Ser. No. 11/829,017, filed Jul. 26, 2007, issued as U.S. Pat. No. 7,963,898.

FIELD OF INVENTION

The invention pertains to plastic film produce bags. More particularly, the invention relates to plastic produce bags having no bottom seam and to methods for making the bags. The lack of a bottom seam provides for increased resistance to rupturing. Further, these bags are folded in thirds across their side seams to permit dispensing from a compact roll dispenser.

BACKGROUND OF THE INVENTION

Various designs have been developed for plastic produce bags as well as for methods for making and dispensing the bags.

U.S. Pat. No. 5,611,627 issued to Belias et al. is directed to an easy open thermoplastic bag. The bag is manufactured from a flattened tube of thermoplastic material with transverse heat seals. The transverse heat seals along with the sinusoidally oscillating paths form the tube into two halves or bags. The result of the transverse heat-seals and the cutting paths, is that two bags are formed with seamless bottoms. The sinusoidal cuts in the front and back portions of the tube respectively give rise to a mouth or opening for the bags with tabs that allow for the bags to be more easily opened.

U.S. Pat. No. 4,164,170 issued to Nordin, discloses a method of making bags. The patent describes the manufacturing of a string of bags from a hose-like blank. Since a hose-like blank is used, the bottoms of the resultant bags are continuous in nature and the sides of a bag are formed by welds with separation lines in order to separate one set of bags from another. The hose-like blank is cut into two substantially equal parts along a center line while the cutting lines are offset to form the handles of the finished bag.

U.S. Pat. No. 4,811,418, issued to Reifenhauser is directed to a method for the manufacture of plastic bags with welded side seams. The patent describes the production of two bags side-by-side in parallel from tubular film that is fed in a first direction. The tubular film is cut in a sinusoidal configuration in the center of the film, thus forming two semitubes to form two side seam bags with welded side seams and handle opening portions.

U.S. Pat. No. 2,444,685 issued to Waters is directed to the multiple fabrication method and apparatus for forming liquid-type envelope bags. A supply roll of material with defined edges is passed through feed rolls and around a former plate in order to bring the edges together along a line with a defined space between them. The edges ultimately form the opening of the envelope after having been cut by a cutter into separate envelopes. A pair of transverse welds are formed in the process and the paired envelopes are cut by means of cross-cut knife.

U.S. Pat. No. 5,967,663 issued to Vaquero et al. is directed to a thermoplastic bag structure. The thermoplastic tube is cut into two portions by means of cutting instruments that form sinusoidal paths and hence sinusoidal cuts. Transverse heat seals and transverse perforations separate the tube into pairs of bags such that the folded bottom edge does not require heat sealing and the openings of the resultant bags have "tabs" so that they may be more easily opened.

U.S. Pat. No. 6,488,222, issued to West et al., describes A folded gusseted plastic bag has a first side gusset formed by first, second, and third longitudinal folds, a second side gusset formed by fourth, fifth, and sixth longitudinal folds, a seventh longitudinal fold being on a side of the bag containing the first, second, and third folds and forming a first folded bag flap, and an eighth longitudinal fold which is on a side of the bag containing the fourth, fifth, and sixth folds, the eighth fold forming a second folded bag flap. The folded gusseted bag also is folded into a total of at least eight contiguous plies. A roll of the folded, gusseted bags includes a continuous web of the folded, flattened bags joined along perforated severance lines. Preferably the perforated severance lines further comprise a centrally-located slit. The dispensing system utilizes the roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by said support member in a predetermined position corresponding to the predetermined position of the slit in the tear line.

U.S. Pat. No. 6,379,292, issued to Simhaee, illustrates a continuous web of bags formed of a plurality of layers to be separated along a line of perforations that extends through all of the layers transverse of the web, in which at least one of the outermost layers is detached from the web at the separation line. Apparatus accomplishes this detachment in a moving web by engaging the outermost layer outer surface and exerting a force in a manner to produce the detachment from the separation line. Both the outermost upper and lower web layers can be detached at the separation line.

U.S. Pat. No. 5,967,663, issued to Vaquero et al., discloses a thermoplastic bag structure and method for making and packaging thermoplastic bags such that their tops are easily identified and the bags are easily opened. The method for producing these bags begins with cutting a flattened thermoplastic tube into two portions. At least one of the two portions is then collapsed to form a sheet of material having a pair of thermoplastic layers, a straight folded bottom edge and a pair of top edges, at least one of which has a skewed-cut. Bag side structures are formed in the sheet of material at about bag-width distances apart. The bags are then folded a predetermined number of times, in a direction transverse to the bag side structures, so that the skewed-cut top edge(s) of each of the bags remains exposed.

While other variations exist, the above-described designs for plastic produce bags are typical of those encountered in the prior art. It is an objective of the present invention to provide a produce bag without a bottom seam for additional strength in the bag bottom. It is a further objective to provide a produce bag that provides means to easily identify and open the bag. It is a still further objective of the invention to provide the above-described capabilities in a produce bag that can be easily dispensed from a roll using a compact and inexpensive dispenser. It is a further objective to provide bags that can be formed into compact rolls on cores or without cores. It is yet a further objective to provide a means to manufacture such produce bags using economical and reliable high-speed methods. While some of the objectives of the present invention are disclosed in the prior art, none of the inventions found include all of the requirements identified.

SUMMARY OF THE INVENTION

The present invention addresses all of the deficiencies of side-seamed plastic produce bag inventions and satisfies all of the objectives described above.

(1) A method of making trifold side-seamed plastic produce bags, comprises the steps of: extruding a continuous tube of plastic film and flattening the tube. The tube has an upper surface, a lower surface, first and second side edges. Forming a perforation perpendicular to the first and second side edges across an entire width of the tube. Sealing the tube at a first side seam. The first side seam is spaced from and parallel to the perforation. Sealing the tube at a second side seam. The second side seam is spaced from and parallel to the first side seam. Cutting the upper surface and the lower surface to form two facing bag streams, each of said bag streams having a first predetermined width. Folding each of the bag streams to approximately one third of the first predetermined width.

(2) In a variant of the method of making trifold side-seamed plastic produce bags, the method includes the further step of corona treating at least one of the upper surface and the lower surface of the flattened tube.

(3) In a further variant of the method includes the further step of printing advertising or informational material on at least one of the corona treated surfaces of the flattened tube.

(4) In still a further variant of the method includes the further step of rolling each of the bag streams to form a bag roll.

(5) In yet a further variant of the method includes the further step of rolling each of the bag streams about a cylindrical core to form a bag roll.

(6) In another variant of the method, each of the bag streams is folded in a Z-fold configuration.

(7) In still another variant of the method, each of the bag streams is folded in a C-fold configuration.

(8) In a further variant of the method of making trifold side-seamed plastic produce bags, the method includes the steps of: Extruding a continuous tube of plastic film and flattening the tube. The tube has an upper surface, a lower surface, first and second side edges. Corona treating at least one of the upper surface and the lower surface of the flattened tube. Printing either advertising or informational material on at least one of the corona treated surfaces of the flattened tube. Forming a perforation perpendicular to the first and second side edges across an entire width of the tube. Sealing the tube at a first side seam spaced from and parallel to the perforation. Sealing the tube at a second side seam. The second side seam is spaced from and parallel to the first side seam. Winding the tube onto a core for later cutting of the upper surface and the lower surface to form two facing bag streams, each of said bag streams having a first predetermined width. Folding each of said bag streams to approximately one third of said first predetermined width.

(9) In still a further variant of the method of making trifold side-seamed plastic produce bags, the method includes the step of rolling each of said bag streams to form a bag roll.

(10) In another variant of the method of making trifold side-seamed plastic produce bags, the method includes the step of rolling each of said bag streams about a cylindrical core to form a bag roll.

(11) In still another variant of the method, each of said bag streams is folded in a Z-fold configuration.

(12) In yet another variant of the method, each of said bag streams is folded in a C-fold configuration.

DESCRIPTION OF THE DRAWINGS

FIG. 1 is a perspective view of the preferred embodiment of the invention, a trifold side seamed produce bag as formed in FIG. 1A;

FIG. 1A is a perspective view of the FIG. 1 embodiment of the invention as the bags are formed, illustrating two facing streams of side seamed plastic produce bags attached with perforations;

FIG. 17 is a perspective view of the preferred embodiment of the invention, a trifold side seamed produce bag as formed in FIG. 17A;

FIG. 17A is a perspective view of the FIG. 17 embodiment of the invention as the bags are formed, illustrating two facing streams of side seamed plastic produce bags attached with perforations;

FIG. 17B is a perspective view of the FIG. 17 embodiment after folding in thirds;

FIG. 19 is a perspective view of the FIG. 18 embodiment further illustrating corona treatment and printing of the tube prior to slitting;

FIG. 20 is a perspective view of a coreless roll of the FIG. 17 bags;

FIG. 21 is a perspective view of a cored roll of the FIG. 17 bags;

FIG. 22 is a perspective view of the FIG. 17 bag folded into a Z-fold configuration;

FIG. 23 is a perspective view of the FIG. 17 bag folded into a C-fold configuration;

Figure 1B:
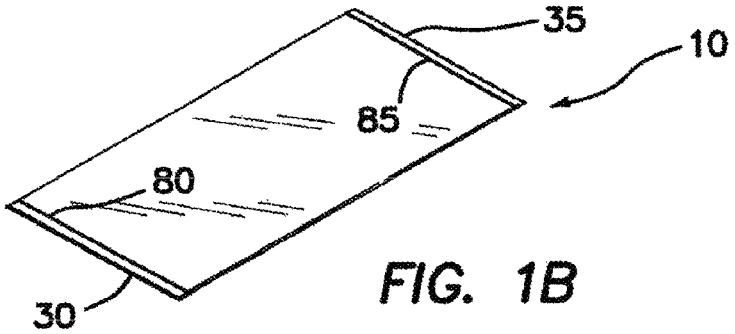
FIG. 1B is a perspective view of the FIG. 1 embodiment after folding in thirds.
Figure 6:
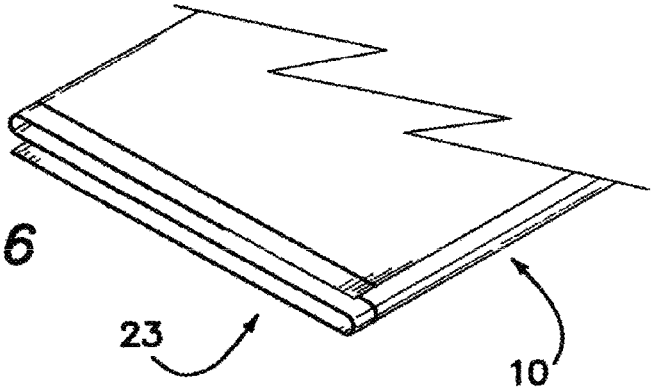
FIG. 6 is a perspective view of the FIG. 1 bag folded into a Z-fold configuration.
Figure 7:
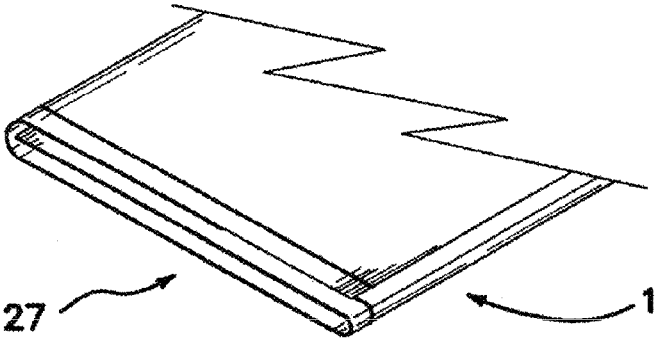
FIG. 7 is a perspective view of the FIG. 1 bag folded into a C-fold configuration.
Figure 2:
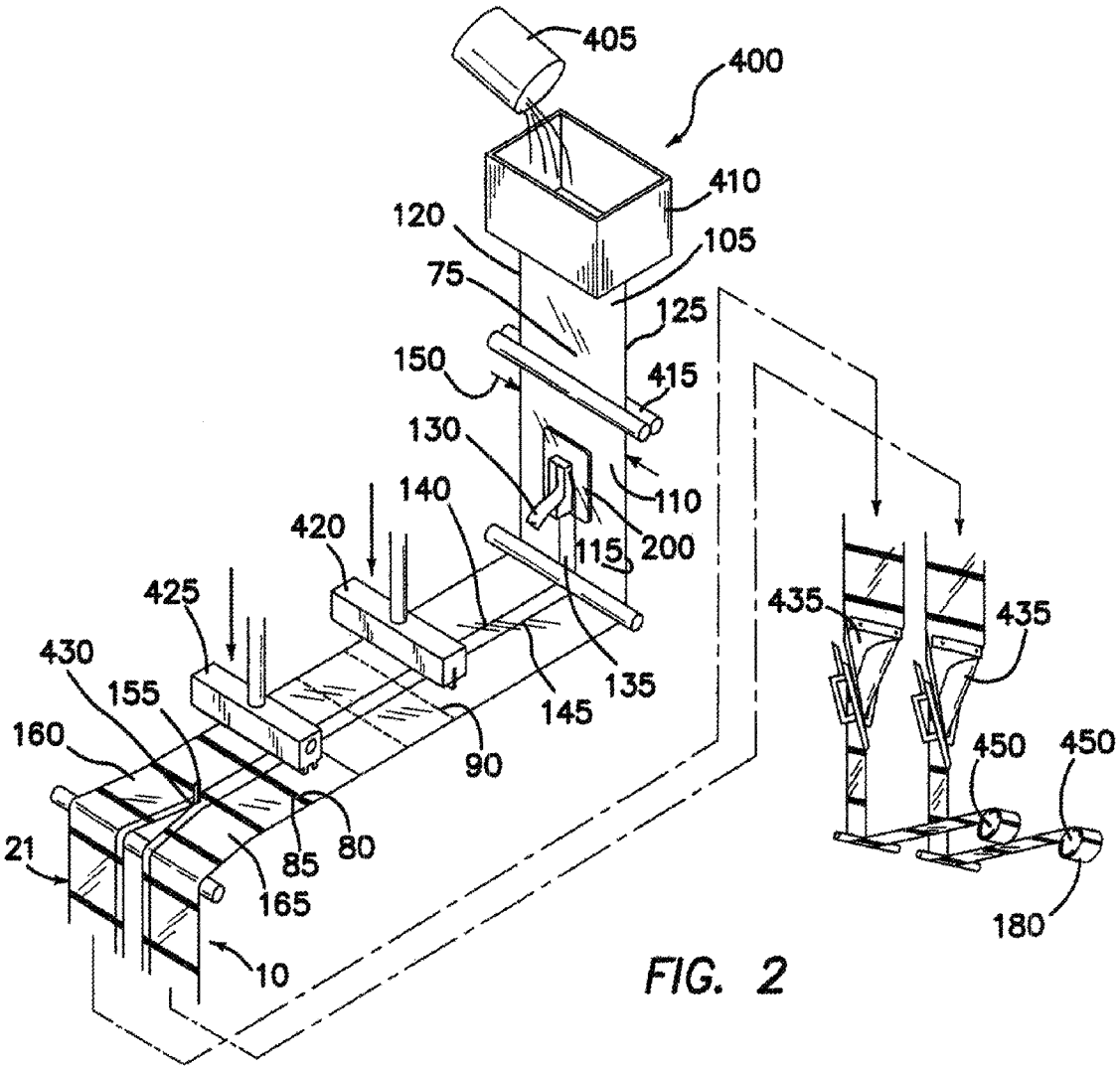
FIG. 2 is a perspective view of a first method of making the invention illustrating the flattening and slitting of the tube, perforating the tube, sealing the bag side edges, cutting the two facing bag streams apart, folding them in thirds and winding them on rolls.
Figures 3, 4, 5:
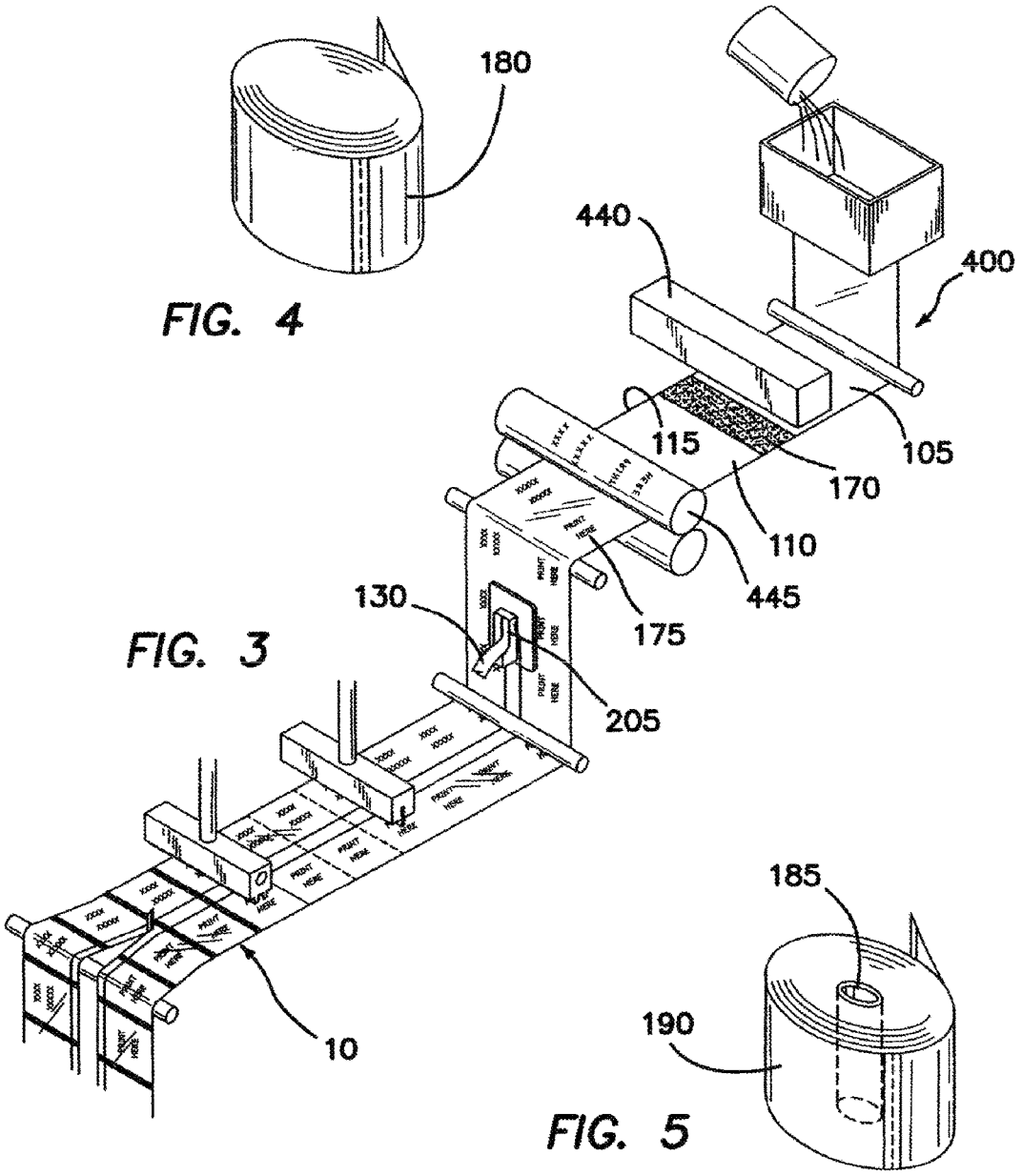
FIG. 3 is a perspective view of the FIG. 2 embodiment further illustrating corona treatment and printing of the tube prior to slitting.
FIG. 4 is a perspective view of a coreless roll of the FIG. 1 bags.
FIG. 5 is a perspective view of a cored roll of the FIG. 1 bags.
Figure 8:
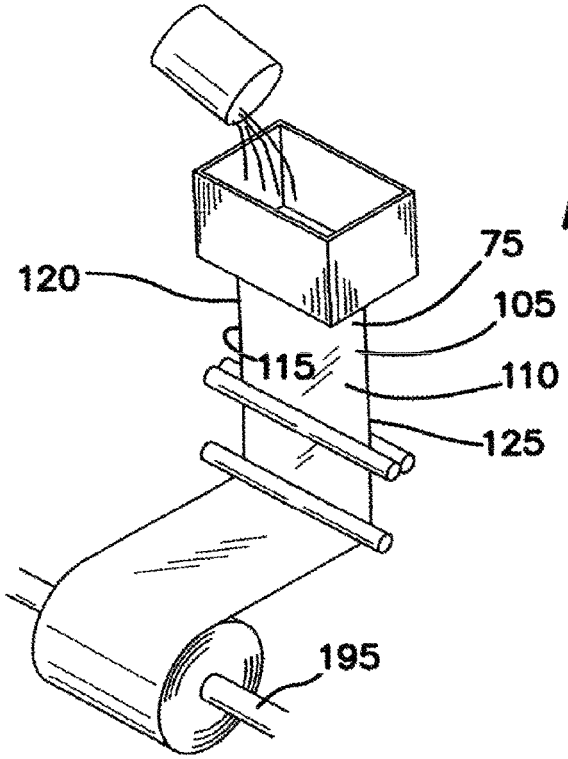
FIG. 8 is a perspective view of a process for forming a flattened plastic tube and rolling same onto a core for later processing.
Figure 9:
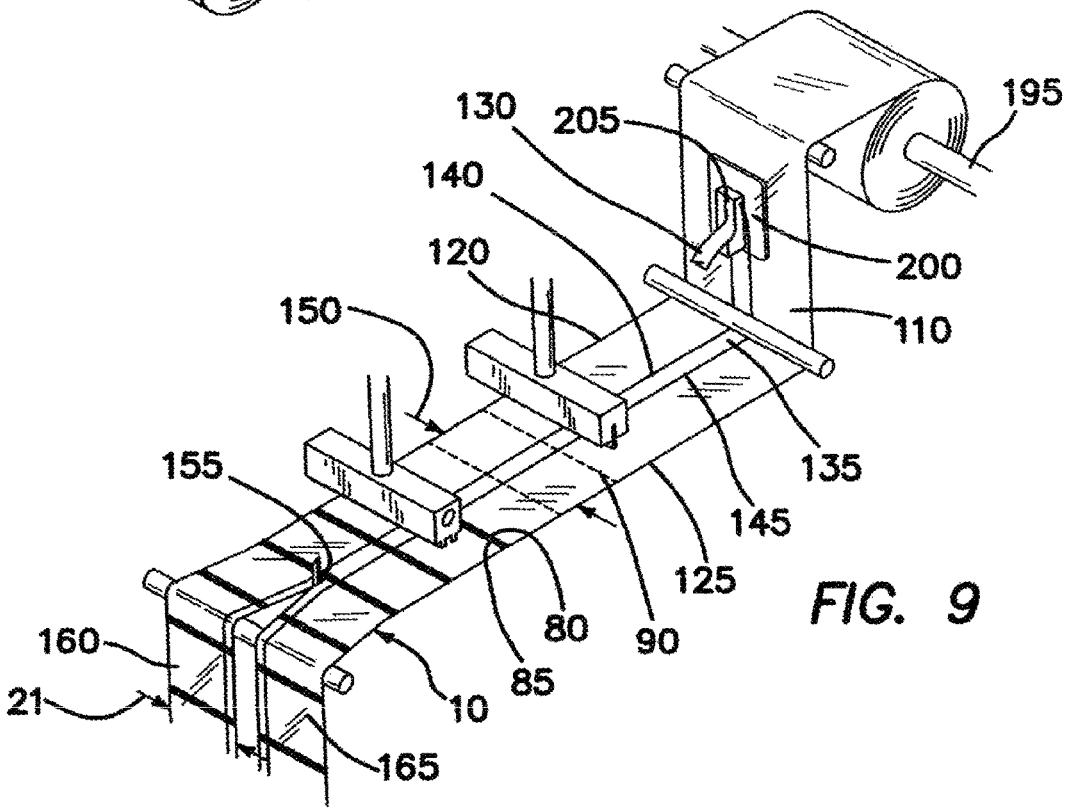
FIG. 9 is a perspective view of a second portion of the FIG. 8 process in which the printed tube is slit, perforated, sealed and cut into two facing bag streams.
Figure 10:
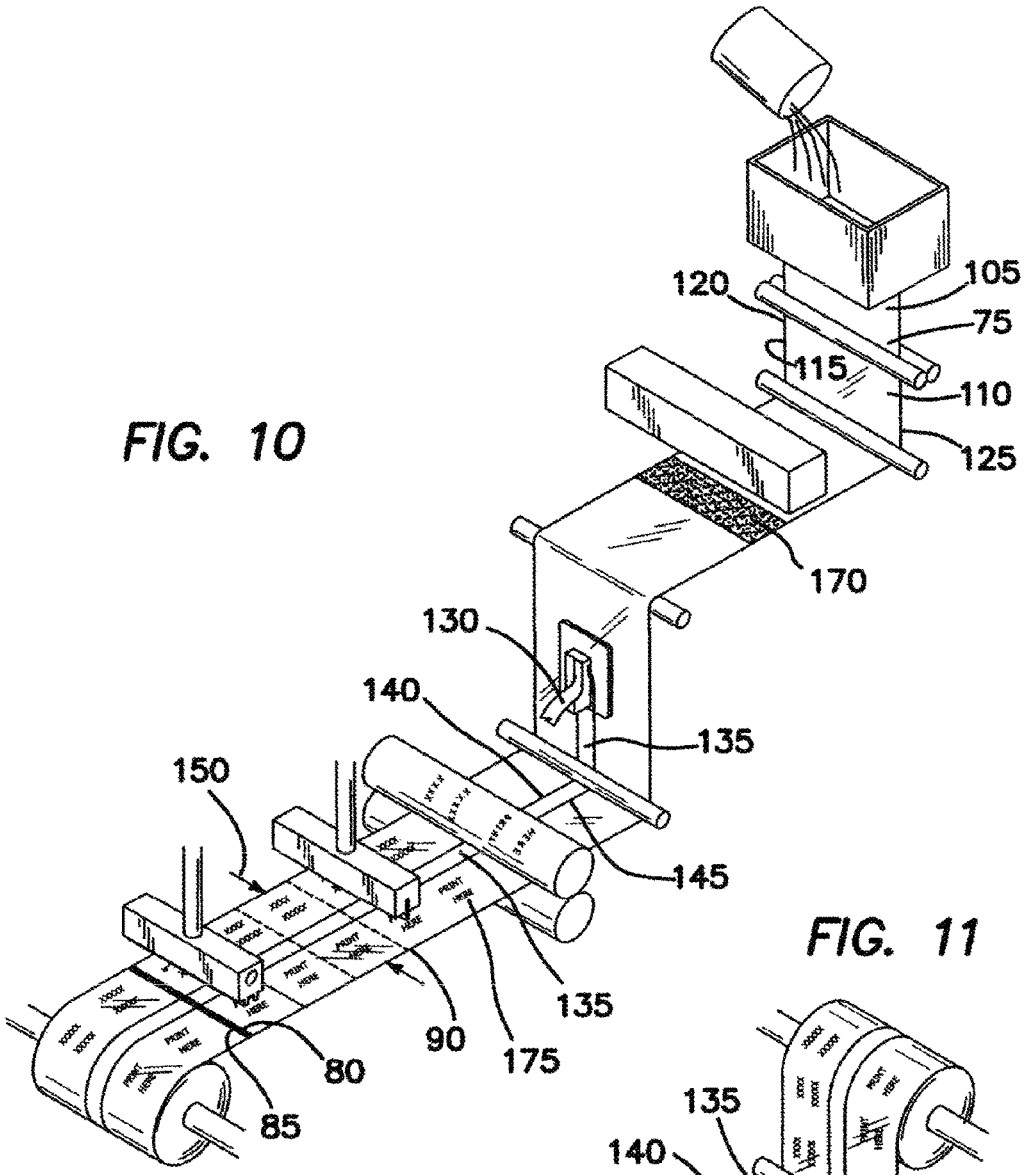
FIG. 10 is a perspective view of another method of making the FIG. 1 bags by corona treating, slitting, printing, perforating and sealing the tube and winding the tube onto a core for later separation into two facing bag streams.
Figure 11:
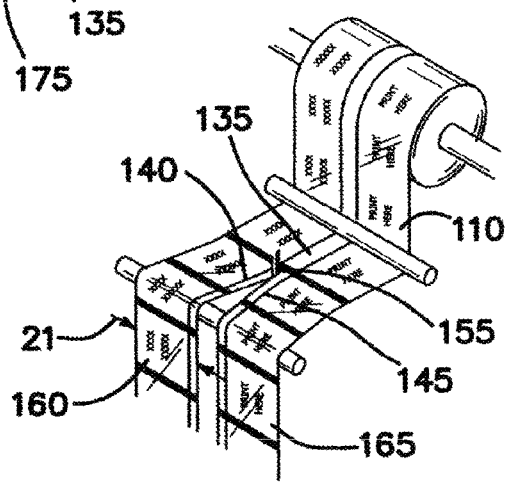
FIG. 11 is a perspective view of a second portion of the FIG. 10 process in which the printed tube, slit, perforated and sealed tube is cut into two facing bag streams.
Figure 12:
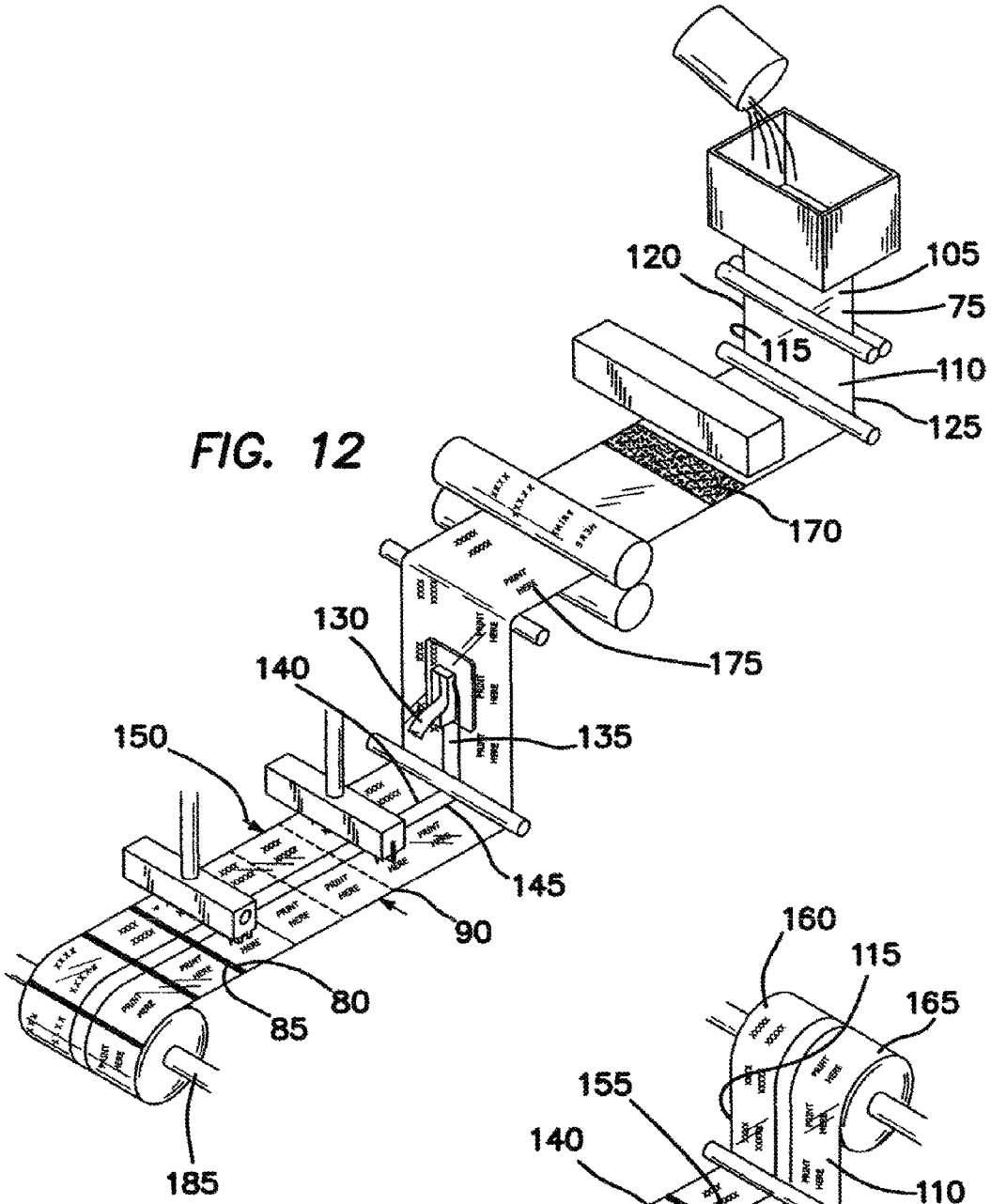
FIG. 12 is a perspective view of still another method of making the FIG. 1 bags by corona treating, printing, slitting, perforating and sealing the tube and winding the tube onto a core for later separation into two facing bag streams.
Figure 13:
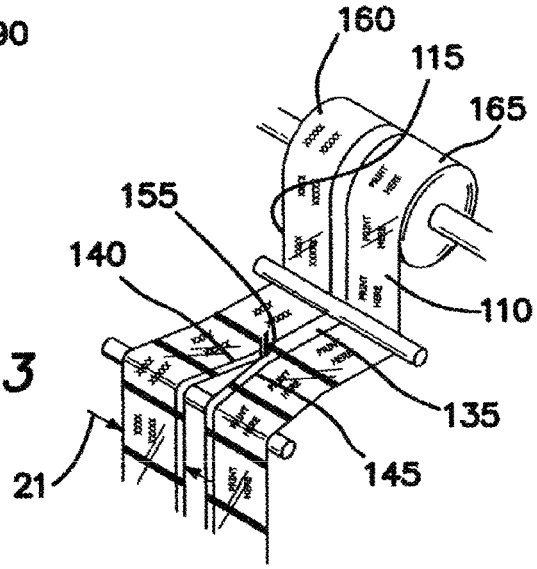
FIG. 13 is a perspective view of a second portion of the FIG. 12 process in which the printed tube, slit, perforated and sealed tube is cut into two facing bag streams.
Figure 14:
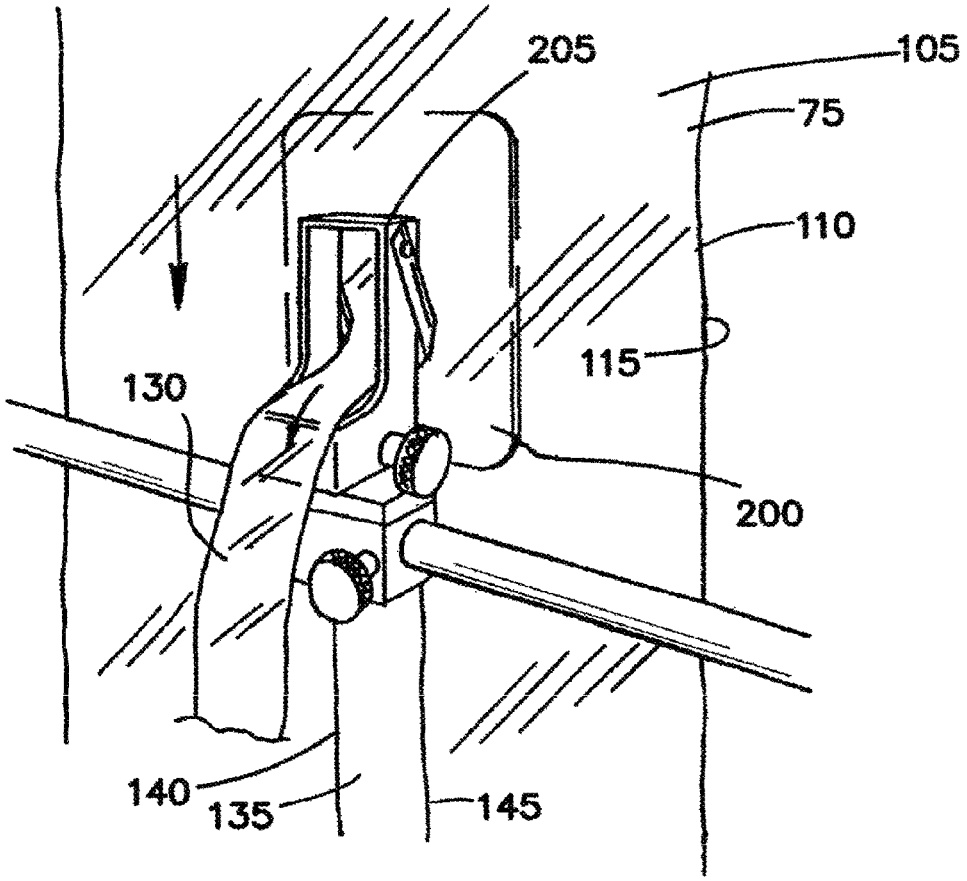
FIG. 14 is a detailed perspective view of a plastic film slitting mechanism removing a central strip from the tube.
Figure 16:
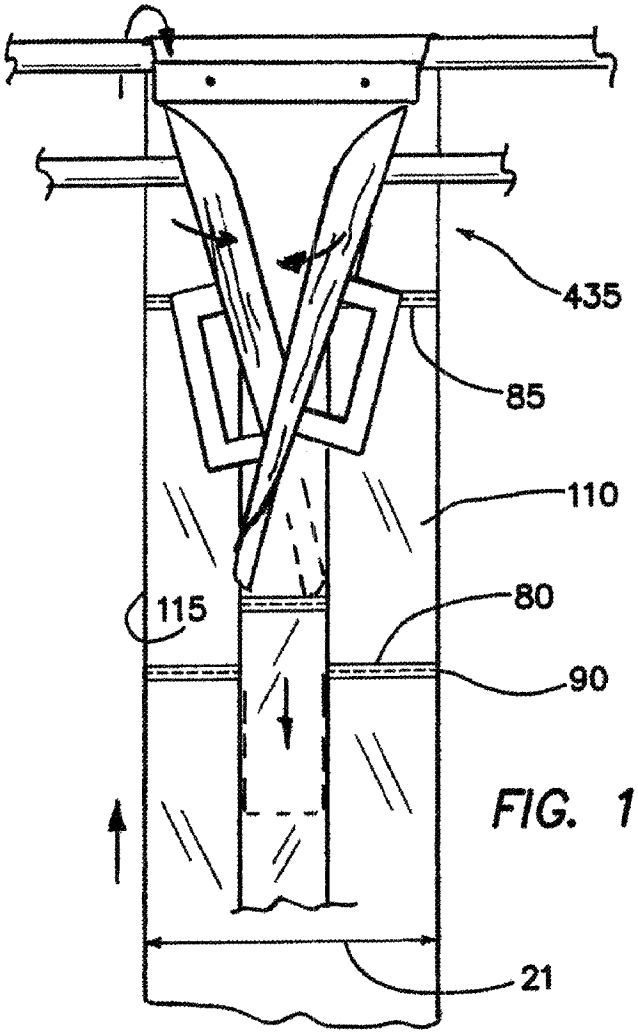
FIG. 16 is a detailed perspective view of the bag folding mechanism operating on a stream of trifold side seamed bags.
Figure 15:
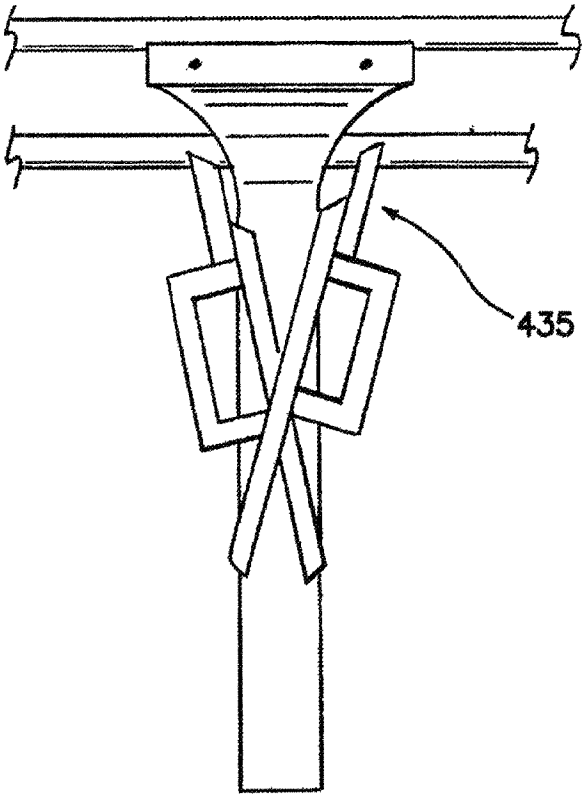
FIG. 15 is a detailed perspective view of a bag folding mechanism capable of folding a bag stream into thirds.
Figure 18:
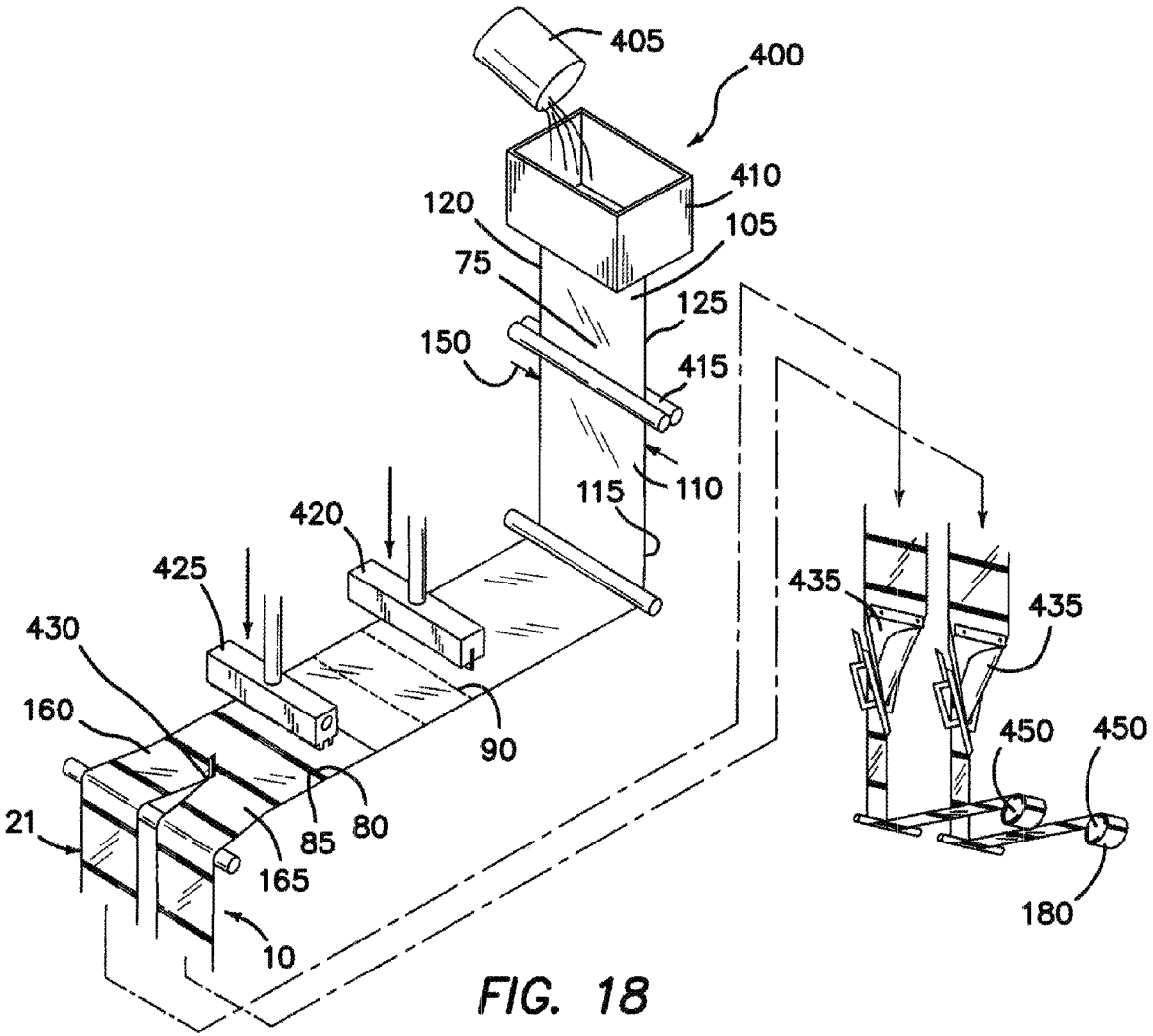
FIG. 18 is a perspective view of a first method of making the invention illustrating the flattening and slitting of the tube, perforating the tube, sealing the bag side edges, cutting the two facing bag streams apart, folding them in thirds and winding them on rolls.

DETAILED DESCRIPTION OF THE PREFERRED EMBODIMENT (1) A method of making trifold side-seamed plastic produce bags 10, as illustrated in FIGS. 18 and 19 comprises the steps of: extruding a continuous tube 105 of thermoplastic film 75 and flattening the tube 105. The tube 105 has an upper surface 110, a lower surface 115, first 120 and second 125 side edges. Forming a perforation 90 perpendicular to the first 120 and second 125 side edges across an entire width 150 of the tube 105. Sealing the tube 105 at a first side seam 80. The first side seam 80 is spaced from and parallel to the perforation 90. Sealing the tube 105 at a second side seam 85. The second side seam 85 is spaced from and parallel to the first side seam 80. Cutting the upper surface 110 and the lower surface 115 to form two facing bag streams 160, 165, each of said bag streams 160, 165 having a first predetermined width 21. Folding each of the bag streams 160, 165 to approximately one third of the first predetermined width 21.

(2) In a variant of the method of making trifold side-seamed plastic produce bags 10, as illustrated in FIG. 19, the method includes the further step of corona treating 170 at least one of the upper surface 110 and the lower 115 surface of the flattened tube 105.

(3) In a further variant of the method, also illustrated in FIG. 19, the method includes the further step of printing advertising or informational material 175 on at least one of the corona treated 170 surfaces 110, 115 of the flattened tube 105.

(4) In still a further variant of the method, as illustrated in FIGS. 18 and 20, the method includes the further step of rolling each of the bag streams 160, 165 to form a bag roll 180.

(5) In yet a further variant of the method, as illustrated in FIG. 21, the method includes the further step of rolling each of the bag streams 160, 165 about a cylindrical core 185 to form a bag roll 190.

(6) In another variant of the method, as illustrated in FIG. 22, each of the bag streams 160, 165 is folded in a Z-fold configuration 23.

(7) In still another variant of the method, as illustrated in FIG. 23, each of the bag streams is folded in a C-fold configuration 27.

Figure 24:
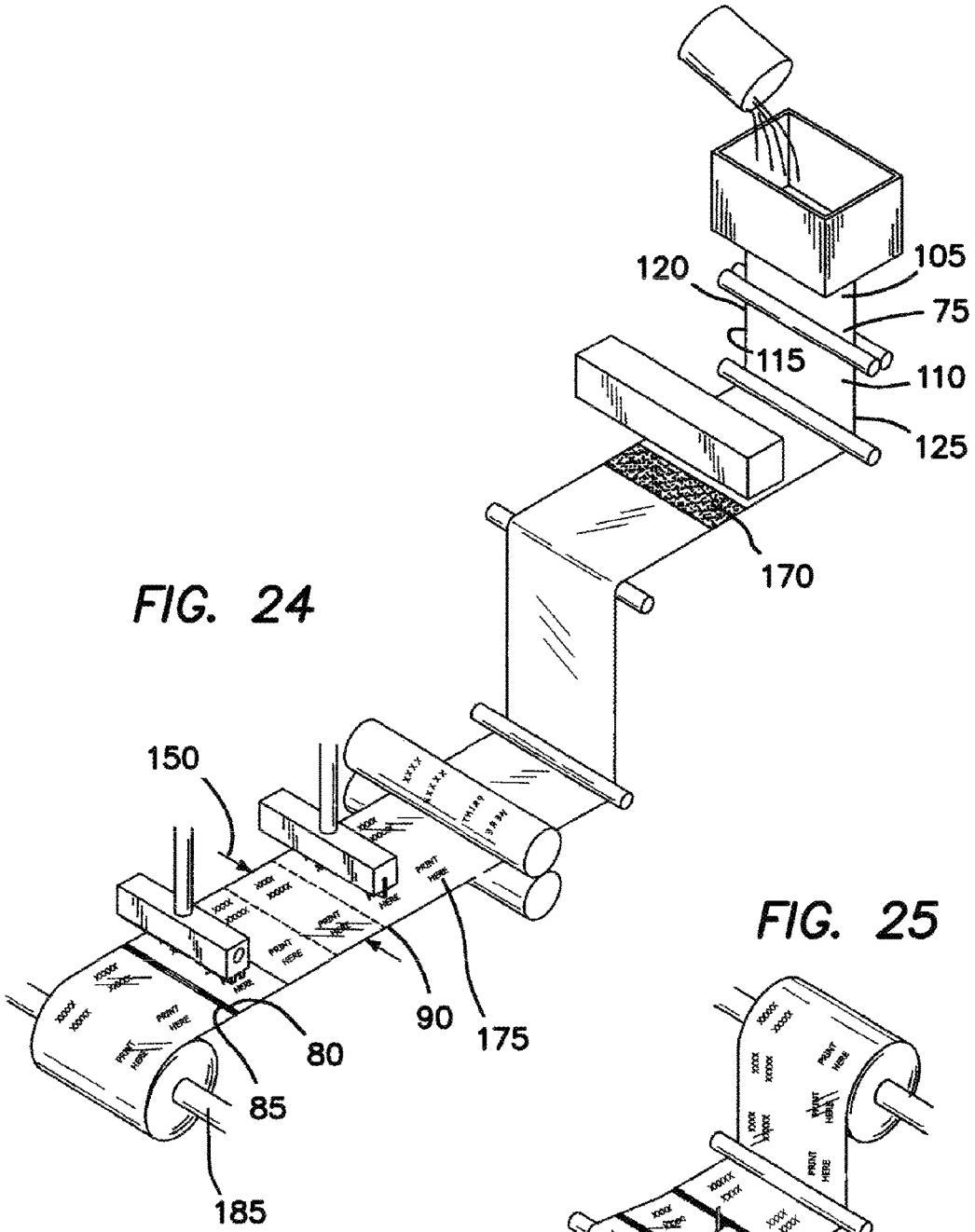
FIG. 24 is a perspective view of another method of making the FIG. 1 bags by corona treating, printing, perforating and sealing the tube and winding the tube onto a core for later separation into two facing bag streams.
Figure 25:
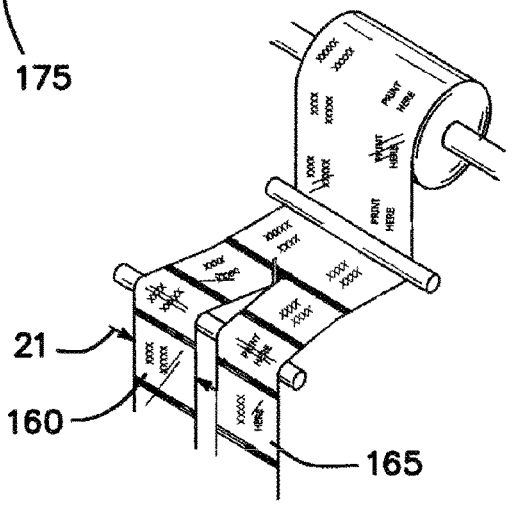
FIG. 25 is a perspective view of a second portion of the FIG. 24 process in which the printed tube, perforated and sealed tube is cut into two facing bag streams.
Figure 27:
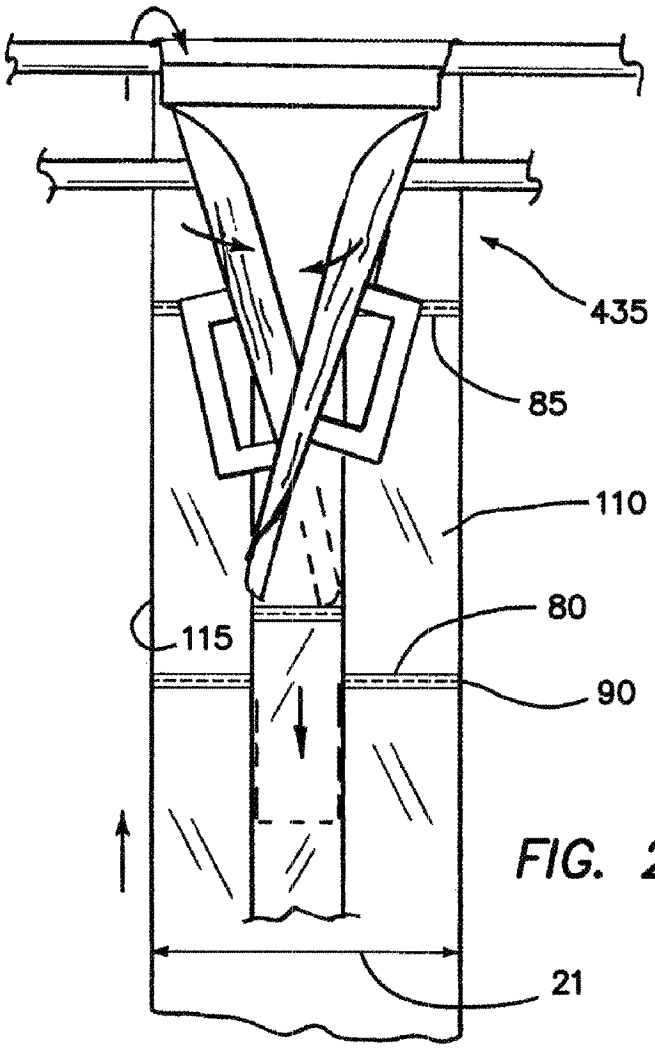
FIG. 27 is a detailed perspective view of the bag folding mechanism operating on a stream of trifold side seamed bags.
Figure 26:
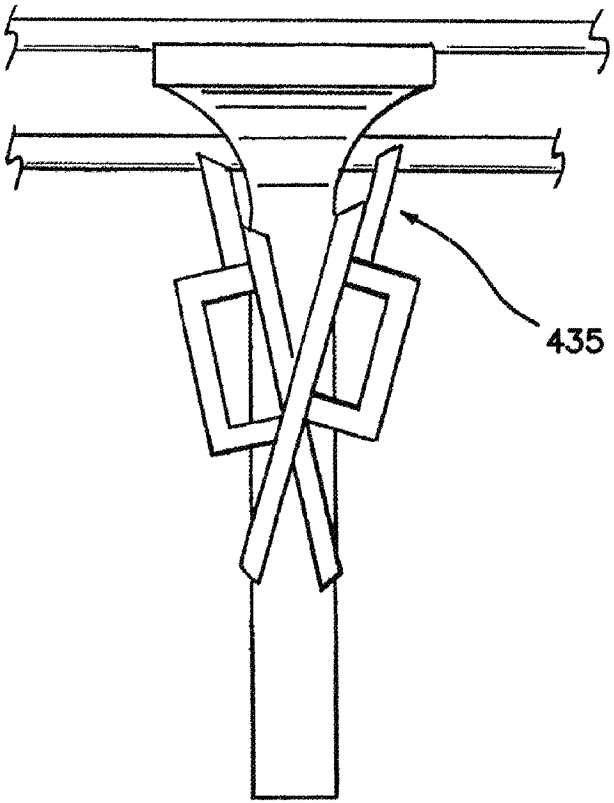
FIG. 26 is a detailed perspective view of a bag folding mechanism capable of folding a bag stream into thirds.

(8) In yet another variant of the method of making trifold side-seamed plastic produce bags 10, as illustrated in FIGS. 24 and 25, the method includes the steps of: Extruding a continuous tube 105 of plastic film 75 and flattening the tube 105. The tube 105 has an upper surface 110, a lower surface 115, first 120 and second 125 side edges. Corona treating 170 at least one of the upper surface 110 and the lower surface 115 of the flattened tube 105. Printing either advertising or informational material 175 on at least one of the corona treated 170 surfaces 110, 115 of the flattened tube 105. Forming a perforation 90 perpendicular to the first 120 and second 125 side edges across an entire width 150 of the tube 105. Sealing the tube 105 at a first side seam 80 spaced from and parallel to the perforation 90. Sealing the tube 105 at a second side seam 85. The second side seam 85 is spaced from and parallel to the first side seam 80. Winding the tube 105 onto a core 185 for later cutting of the upper surface 110 and the lower surface 115 to form two facing bag streams 160, 165, each of said bag streams 160, 165 having a first predetermined width 21. Folding each of the bag streams 160, 165 to approximately one third of the first predetermined width 21, as illustrated in FIG. 18.

(9) In still a further variant of the method, as illustrated in FIG. 20, the method includes the further step of rolling each of the bag streams 160, 165 to form a bag roll 180.

(10) In yet a further variant of the method, as illustrated in FIG. 21, the method includes the further step of rolling each of the bag streams 160, 165 about a cylindrical core 185 to form a bag roll 190.

(11) In another variant of the method, as illustrated in FIG. 22, each of the bag streams 160, 165 is folded in a Z-fold configuration 23.

(12) In still another variant of the method, as illustrated in FIG. 23, each of the bag streams is folded in a C-fold configuration 27.

The Method for Making Tri-fold Side Seamed Produce Bag has been described with reference to particular embodiments. Other modifications and enhancements can be made without departing from the spirit and scope of the claims that follow.

The invention claimed is:

1. A method of making tri-fold side-seamed plastic produce bags, comprising the steps of:

extruding a continuous tube of plastic film;

flattening said tube, said tube having an upper surface, a lower surface, first and second side edges;

forming a perforation perpendicular to said first and second side edges across an entire width of said tube;

sealing said tube at a first side seam spaced from and parallel to said perforation;

sealing said tube at a second side seam, said second side seam being spaced from and parallel to said first side seam;

cutting said upper surface and said lower surface to form two facing bag streams, each of said bag streams having a first predetermined width; and folding each of said bag streams to one third of said first predetermined width.

2. The method of making tri-fold side-seamed plastic produce bags as described in claim 1, further comprising the step of corona treating at least one of said upper surface and said lower surface of said flattened tube.

3. The method of making tri-fold side-seamed plastic produce bags as described in claim 2, further comprising the step of printing either of advertising and informational material on at least one of said corona treated surfaces of said flattened tube.

4. The method of making tri-fold side-seamed plastic produce bags as described in claim 1, further comprising the step of rolling each of said bag streams to form a bag roll.

5. The method of making tri-fold side-seamed plastic produce bags as described in claim 1, further comprising the step of rolling each of said bag streams about a cylindrical core to form a bag roll.

6. The method of making tri-fold side-seamed plastic produce bags as described in claim 1, wherein each of said bag streams is folded in a Z-fold configuration.

7. The method of making tri-fold side-seamed plastic produce bags as described in claim 1, wherein each of said bag streams is folded in a C-fold configuration.

8. A method of making tri-fold side-seamed plastic produce bags, comprising the steps of:

extruding a continuous tube of plastic film;

flattening said tube, said tube having an upper surface, a lower surface, first and second side edges;

corona treating at least one of said upper surface and said lower surface of said flattened tube;

printing either of advertising and informational material on at least one of said corona treated surfaces of said flattened tube;

forming a perforation perpendicular to said first and second side edges across an entire width of said tube;

sealing said tube at a first side seam spaced from and parallel to said perforation;

sealing said tube at a second side seam, said second side seam being spaced from and parallel to said first side seam;

winding said tube onto a core for later cutting of said upper surface and said lower surface to form two facing bag streams, each of said bag streams having a first predetermined width; and folding each of said bag streams to one third of said first predetermined width.

9. The method of making tri-fold side-seamed plastic produce bags as described in claim 8, further comprising the step of rolling each of said bag streams to form a bag roll.

10. The method of making tri-fold side-seamed plastic produce bags as described in claim 8, further comprising the step of rolling each of said bag streams about a cylindrical core to form a bag roll.

11. The method of making tri-fold side-seamed plastic produce bags as described in claim 8, wherein each of said bag streams is folded in a Z-fold configuration.

12. The method of making tri-fold side-seamed plastic produce bags as described in claim 8, wherein each of said bag streams is folded in a C-fold configuration.

* * * * *